US006045683A

United States Patent [19]

Riley et al.

[11] Patent Number: 6,045,683

[45] Date of Patent: Apr. 4, 2000

[54] MODIFIED BRUSHITE SURFACE COATING, PROCESS THEREFOR, AND LOW TEMPERATURE CONVERSION TO HYDROXYAPATITE

[75] Inventors: Clyde Riley; Mukesh Kumar, both of Huntsville, Ala.

[73] Assignee: University of Alabama in Huntsville, Huntsville, Ala.

[21] Appl. No.: 08/980,839

[22] Filed: Dec. 1, 1997

[51] Int. Cl.[7] ..... C25D 9/02

[52] U.S. Cl. ..... 205/318; 205/50; 623/16

[58] Field of Search ..... 205/318, 50; 423/308, 423/307; 106/501.1

[56] References Cited

U.S. PATENT DOCUMENTS

| | | | |
|---|---|---|---|
| 5,068,122 | 11/1991 | Kokubo et al. | 427/2 |
| 5,279,831 | 1/1994 | Constantz et al. | 424/423 |
| 5,310,464 | 5/1994 | Redpenning | 204/180.2 |
| 5,330,826 | 7/1994 | Taylor et al. | 428/216 |
| 5,338,433 | 8/1994 | Maybee et al. | 205/178 |
| 5,413,693 | 5/1995 | Redpenning | 205/318 |
| 5,458,863 | 10/1995 | Klassen | 423/307 |
| 5,462,722 | 10/1995 | Liu et al. | 423/311 |
| 5,723,038 | 3/1998 | Scharnweber et al. | 205/107 |
| 5,759,376 | 6/1998 | Teller et al. | 205/50 |

OTHER PUBLICATIONS

Brown, "Phase Relationships in the Ternary System $CaO–P_2O_5–H_2O$ at 25°C", *Journal of the American Ceramic Society*, vol. 75, No. 1, pp. 17–22 Apr. 1992.

*Primary Examiner*—Kathryn Gorgos
*Assistant Examiner*—Erica Smith-Hicks
*Attorney, Agent, or Firm*—Alston & Bird LLP

[57] ABSTRACT

The invention provides a brushite coating that is easily convertible to hydroxyapatite at mild conditions. The brushite coating is rapidly electrodeposited from an aqueous electrolyte solution of calcium phosphate, monobasic and salts having cations of ammonium, alkali metals and alkaline earth metals. About 1 to 5 percent of the calcium ions in the brushite coating are substituted with ammonium, alkali metals or alkaline earth metal cations. Hydroxyapatite can be formed by immersing the brushite coating in an animal or human body fluid or a simulated body fluid at from about 20 to 37° C. Substantially stoichiometric calcium hydroxyapatite is formed.

34 Claims, 9 Drawing Sheets

MODIFIED BRUSHITE SURFACE COATING, PROCESS THEREFOR, AND LOW TEMPERATURE CONVERSION TO HYDROXYAPATITE

FIELD OF THE INVENTION

This invention relates to calcium phosphate ceramic coatings on conductive metal substrates. In particular, this invention relates to the preparation of brushite coatings on metal substrates and the subsequent conversion of the brushite coating to calcium hydroxyapatite.

BACKGROUND OF THE INVENTION

Calcium hydroxyapatite, which has the formula $Ca_{10}(PO_4)_6(OH)_{21}$ is the major constituent of bone and tooth mineral. Paul Brown in his paper *Phase Relationships in the Ternary System* CaO—$P_2O_5$—$H_2O$ at 25° C. teaches that hydroxyapatite should be viewed as a defect structure that exists over a compositional range $Ca_{(10-x)}(HPO_4)_x(PO_4)_{(6-x)}(OH)_{(2-x)}$, where $x \leqq 1$ and includes calcium deficient non-stoichiometric hydroxyapatite having calcium vacancies in the structure. *J. Am. Ceram. Soc.*, 75 [1] 17 through 22 (1992).

Redpenning U.S. Pat. No. 5,310,464 describes the preparation by electrolysis of brushite coatings on metallic prosthetic appliances. The electrolyte is said to comprise an aqueous solution containing $Ca^{2+}$ and dihydrogen phosphate ions. Brushite is calcium phosphate, dibasic and has the formula $CaHPO_4.2H_20$. Calcium phosphate ceramic coatings are said to accelerate bone fixation during the early recuperative stages after implantation of the prosthetic appliance.

Taylor et al. U.S. Pat. No. 5,330,826 describes depositing calcium phosphate ceramic coatings on metal substrates by electrolysis from an aqueous electrolyte solution that includes a salt of the anode metal. One example is cobalt sulfate. The cobalt metal is co-deposited with the calcium phosphate material and is said to secure the calcium phosphate material to the substrate and to increase the bond strength between the substrate and the calcium phosphate material. Nickel, chromium, or rhodium salts are disclosed for like anode materials.

Maybee et al. U.S. Pat. No. 5,338,433 describes codepositing a three component system of cobalt, chromium, and molybdenum to fix calcium phosphate materials to a substrate surface. A chelating element, EDTA, is used in the electrolyte to successfully electroplate cobalt and chromium simultaneously since the cobalt deposition rate would otherwise be too fast relative to that for chromium. The aqueous electrolyte provides ions of cobalt, chromium, and molybdenum from various soluble salts of these elements.

Klassen U.S. Pat. No. 5,458,863 describes a process for coating a metal substrate with hydroxyapatite that includes coating the metal substrate with brushite by electrolysis, periodically dislodging bubbles from the substrate during the electrolysis, and then converting the brushite coating to hydroxyapatite by immersing the metal substrate into an aqueous conversion liquor. The electrolyte for the brushite electrodeposition step is described as an aqueous solution of calcium phosphate, monobasic. The conversion liquor is said to comprise water and sufficient potassium hydroxide so that the pH of the liquor is about 10. At 80° C., the conversion is said to be complete within 36 hours. Higher conversion temperatures are said to permit a shorter conversion time.

Hydroxyapatite coatings on medical implants have shown increased bone apposition in shorter periods of time than uncoated implants. A hydroxyapatite precursor, brushite, can be applied to metallic substrates of the type used for medical implants by several methods. Various physical and chemical vapor deposition techniques and electrolysis are described for this purpose. However, it would be desirable to provide faster, easier, milder, and more economical methods for coating prosthetic implants.

SUMMARY OF THE INVENTION

The invention includes a brushite coating on a metal substrate that can be produced by electrolysis and that is easily convertible to hydroxyapatite at moderate temperatures and in fluids including human body fluid or simulated body fluid. Selected cations, typically sodium or potassium, are incorporated into the brushite coating by replacement of a portion of the calcium ions that would normally be present.

Other alkali metals and alkaline earth metals can be used in the practice of the invention, including lithium, rubidium, cesium, francium, beryllium, magnesium, strontium, barium, and radium, although not necessarily with equivalent results. Some of these metals are radioactive or otherwise toxic and are not usually desirable in the human body. Ammonium ion is useful in the practice of the invention.

The electrolyte solution is highly conductive and promotes preparation of brushite coatings at favorable electrodeposition rates. While not wishing to bound by theory, it is believed that the electrodeposited modified brushite coating is in a much higher energy state than typical brushite coatings, so that its conversion to hydroxyapatite is rapid and can occur at relatively mild temperatures, including the temperature of the human body. X-ray diffraction spectra show enhancement of high diffracting angle planes as compared to an unmodified brushite. Enhancement of high diffracting angle planes is believed to be due to the strain imposed on the crystal structure by the ion substitution.

The calcium phosphate ceramic coating of the invention has the formula $X_a$—$HPO_4.2H_2O$, wherein from about 95 to 99 percent of the cations X are calcium cations, by atomic percent, and wherein the remainder of the cations X are ammonium, alkali metals, or alkaline earth metals, and mixtures thereof. It should be recognized that "a" in the formula $X_a$—$HPO_4.2H_2O$ is 1 for divalent calcium and the remaining Group IIA metals and "a" is 2 for univalent ammonium cation and the Group IA metals so that the appropriate number of atoms is present to maintain charge neutrality.

The method of the invention includes a method of applying the coating to a metal substrate by electrodepositing the coating from an aqueous electrolyte solution of calcium phosphate, monobasic and salts having cations of ammonium, alkali metals, and alkaline earth metals. The coating can be converted to hydroxyapatite within about 48 hours by contacting the coating with an animal or human body fluid or substance simulating the composition of a body fluid at moderate temperatures of from about 20 to 37° C. It should be possible to convert the coating to calcium hydroxyapatite by contact with an animal or human body fluid in vivo.

The invention includes an electrolytic cell and aqueous electrolyte as described above and a process for converting the brushite coating to calcium hydroxyapatite. The invention is capable of producing stoichiometric or substantially near stoichiometric calcium hydroxyapatite, $Ca_{10}(PO_4)_6(OH)_2$. Calcium hydroxyapatite within the context of the invention includes non-stoichiometric forms and should be considered to have the formula $Ca_{(10-x)}(HPO_4)_x(PO_4)_{(6-x)}(OH)_{(2-x)}$.

Thus, the invention provides a high conductivity electrolyte for rapidly and easily electrodepositing a brushite coating in which from about 1 to 5 percent of the calcium ions are substituted with ammonium, alkali metals, or alkaline earth metal cations. This modified brushite coating is easily convertible to hydroxyapatite at mild conditions and should be suitable for in vivo conversion of the coating to calcium hydroxyapatite.

The foregoing and other objects, advantages, and features of the invention, and the manner in which the same are accomplished will be more readily apparent on consideration of the following detailed description of the invention taking in conjunction with the accompanying figures, which illustrate preferred and exemplary embodiments, and wherein:

DETAILED DESCRIPTION

Figure 1:
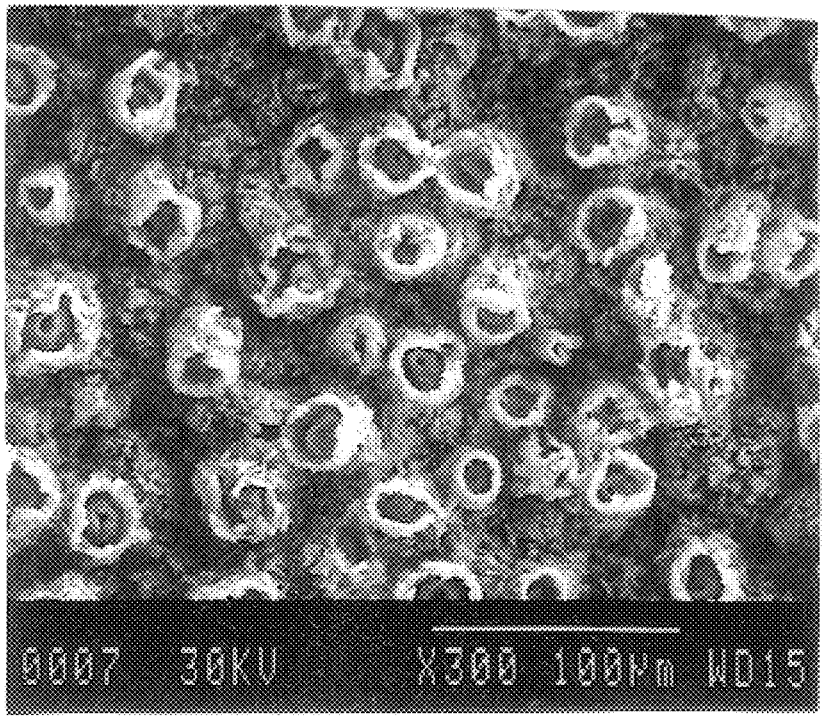
FIG. 1 is a scanning electron micrograph of a modified brushite coating of the invention electrodeposited on a titanium coupon.

The scanning electron micrograph ("SEM") of FIG. 1 shows a crystalline brushite coating that has been modified in accordance with the invention after about 2 minutes of electrodeposition on a titanium coupon. The electrolyte from which the coating was formed comprises calcium dihydrogen phosphate that is saturated in an aqueous solution of potassium chloride. Depletion of calcium cations in the vicinity of the cathode results in substitution of other available cations, which in this case is potassium, to replace the depleted calcium cations in the rapidly forming brushite.

Figure 2:
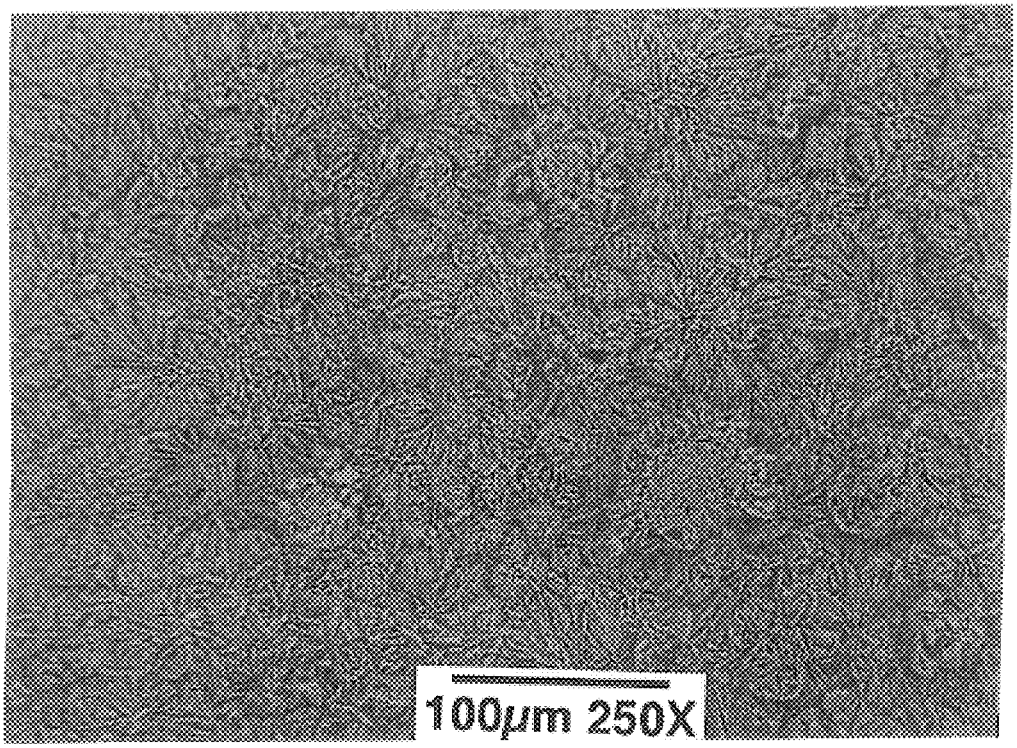
FIG. 2 is a scanning electron micrograph of a brushite that has not been modified electrodeposited on a titanium coupon.

The crystal morphology of the fast growing modified brushite is altered compared to brushite that is not modified (FIG. 2). The fast growing areas in the circular region shown in FIG. 1 have the greatest electrolyte cation substitution for calcium. FIG. 2 shows that the unmodified brushite has a uniform needle-like crystal structure in comparison to the modified brushite of FIG. 1.

Brushite is another name for the dihydrate of calcium phosphate, dibasic, which has the formula $CaHPO_4.2H_2O$. Brushite is also known as dicalcium orthophosphate, bicalcium phosphate, and secondary calcium phosphate. Brushite is not presently an FDA approved material for use in humans and normally must be converted to hydroxyapatite prior to being used in humans.

The modified brushite of FIG. 1 has the formula $X_a$—$HPO_4.2H_2O$ in which X is from about 95 to 99% calcium and from about 1 to 5% potassium, by atomic percent. The subscript "a" is 1 for calcium and 2 for potassium to maintain charge neutrality. Thus, the modified brushite comprises $CaHO_4.2H_2O$ and $K_2HPO_4.2H_2O$. It should be recognized that if a mixture of cations is available, then additional modified brushite species will normally be formed. Two different metals can be present in the same molecule so long as charge neutrality is maintained.

A variety of cations can be used for substitution of the calcium cations in brushite. Suitable cations are ammonium, alkali metals, which are the Group IA metals of the Periodic Table, and alkaline earth metals, which are the Group IIA metals of the Periodic Table. The Group IA and Group IIA metals include lithium, sodium, potassium, rubidium, cesium, francium, beryllium, magnesium, strontium, and radium. Calcium is also a Group IIA alkaline earth metal. It should be apparent to the skilled artisan that although the Group IA and IIA metals should be suitable for use in the practice of the invention, not all of these metals normally are practical or desirable for use in preparing coatings that are ultimately designed for implantation in the human body.

Hydroxyapatite is a coating material approved by the Federal Drug Administration for use in the human body. The brushite coating of the invention can be converted to hydroxyapatite and this conversion is enhanced by comparison to conversion of a typical unmodified brushite. It is believed that the modified brushite of the invention is in a somewhat higher energy state than unmodified brushite. The conversion can be carried out relatively quickly at mild temperatures ranging from ambient to normal body temperature by immersion in a simulated or actual human or animal body fluid.

Figure 3:
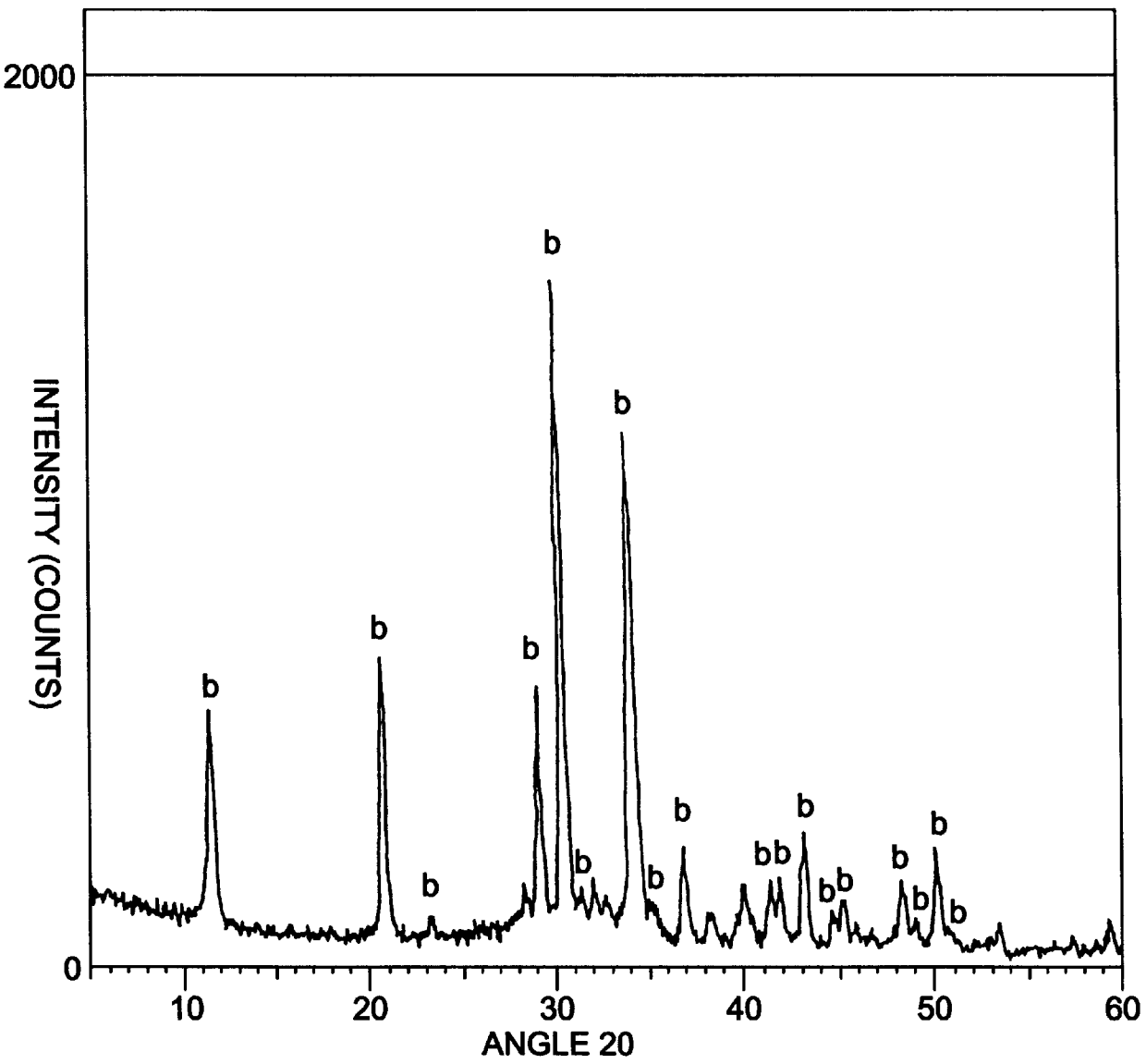
FIG. 3 is an X-ray diffraction spectrum of a modified brushite coating of the invention electrodeposited on a titanium coupon.
Figure 4:
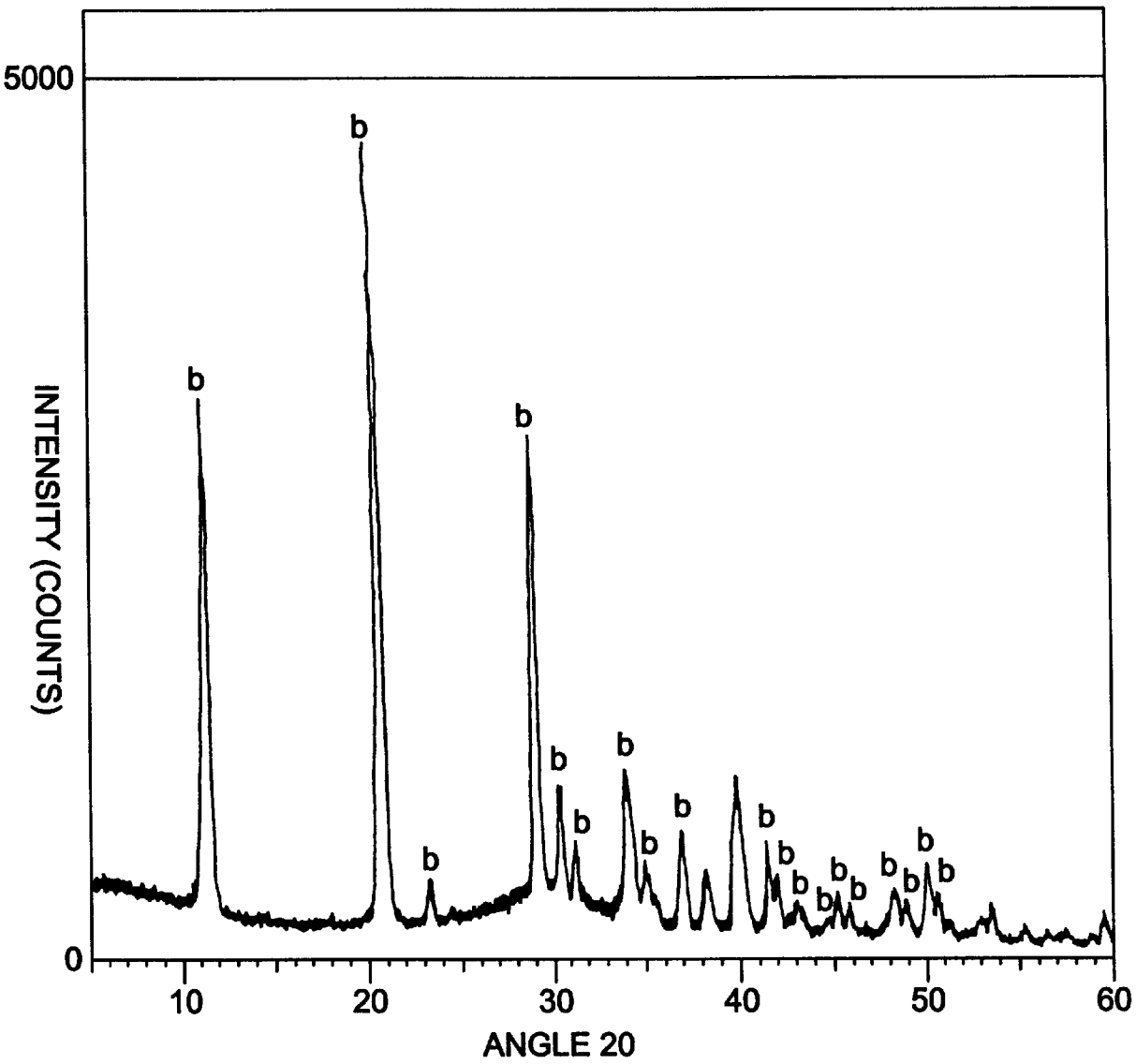
FIG. 4 is an X-ray diffraction spectrum of a brushite that has not been modified electrodeposited on a titanium coupon.

FIGS. 3 through 10 are comparative X-ray diffraction spectra showing the cation-substituted brushite of the invention compared to a brushite that is not substituted. FIGS. 3 and 4 compare the modified brushite of the invention to the unmodified brushite, respectively. Standard brushite peak locations according to the Joint Committee for Powder Diffraction Standards are denoted by the letter "b". The highest intensity peaks are shown at 11.5°, 21.0°, and 29.2° for the unmodified brushite. However, the modified brushite has its highest intensity peaks at 30.5° and at 34.3°. The intense peaks found in the unmodified brushite at the lower angles of 11.5°, 21.0°, and 29.2°, are diminished in the modified brushite. This alteration is believed to be due to the strain imposed on the crystal structure by cation substitution.

FIGS. 5 through 10 show comparisons in the conversion to calcium hydroxyapatite of the modified brushite of the invention and an unmodified brushite. A simulated body fluid was used for the conversion that comprised about 8 grams per liter of sodium chloride, about 0.4 grams per liter of potassium chloride, about 0.06 grams per liter of potassium diphosphate, about 0.35 grams per liter of sodium bicarbonate, and about 0.09 grams per liter of disodium phosphate heptahydrate. The brushite coating that has been formed on the metal substrate by electrolysis dissolves in the simulated body fluid solution and reprecipitates as stoichiometric or substantially near stoichiometric hydroxyapatite of the formula $Ca_{10}(PO_4)_6(OH)_2$. The simulated body fluid contains some sodium bicarbonate and so some carbonate is formed in the hydroxyapatite coating, which is desirable and results in a coating that more closely approaches the composition of human bone. It is to be expected that conversion in animal or human body fluid would be similar and that the conversion should be possible in vivo.

Figure 5:
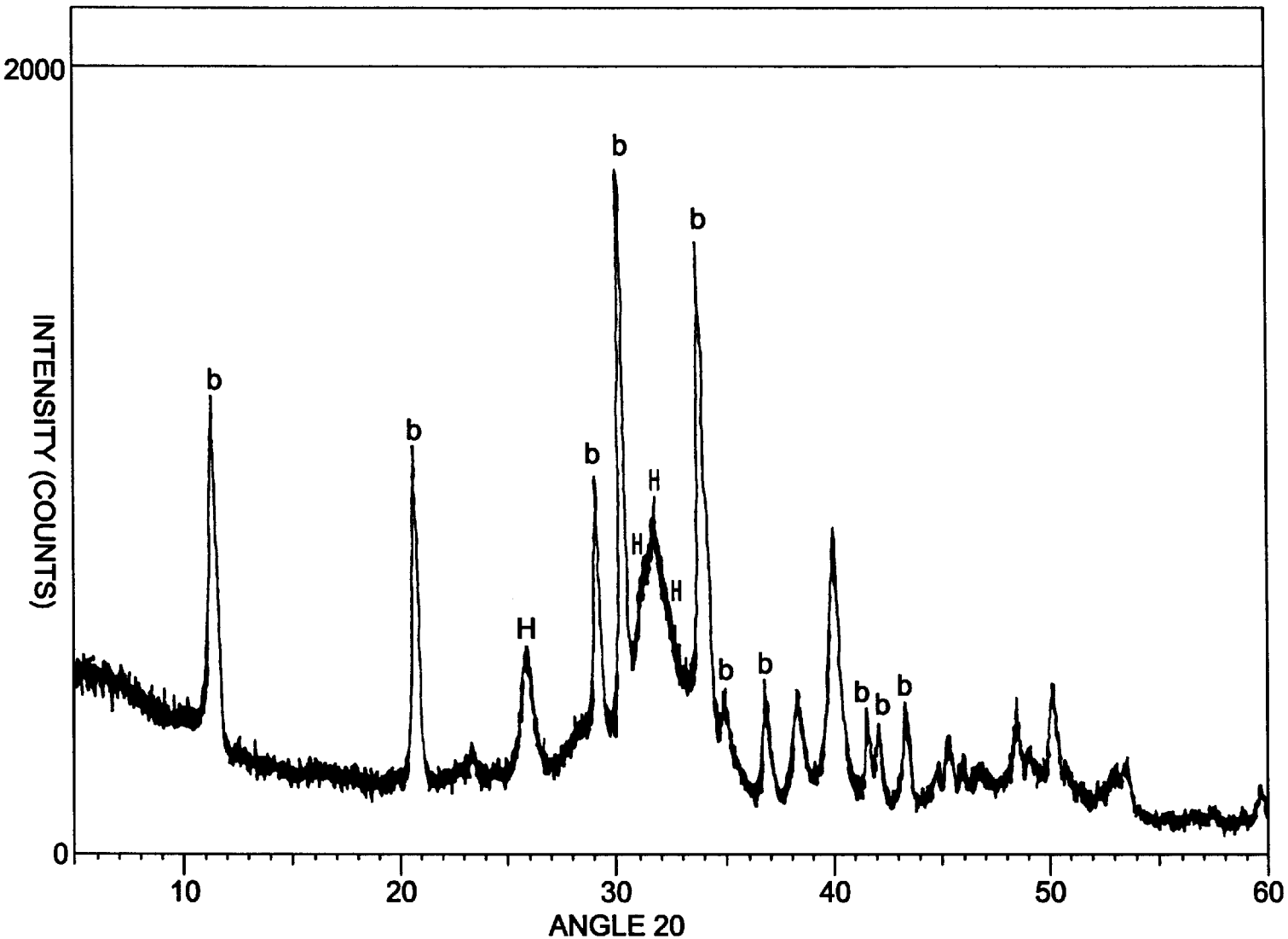
FIG. 5 is an X-ray diffraction spectrum for a modified brushite of the invention after 18 hours of immersion in a simulated body fluid at room temperature.
Figure 6:
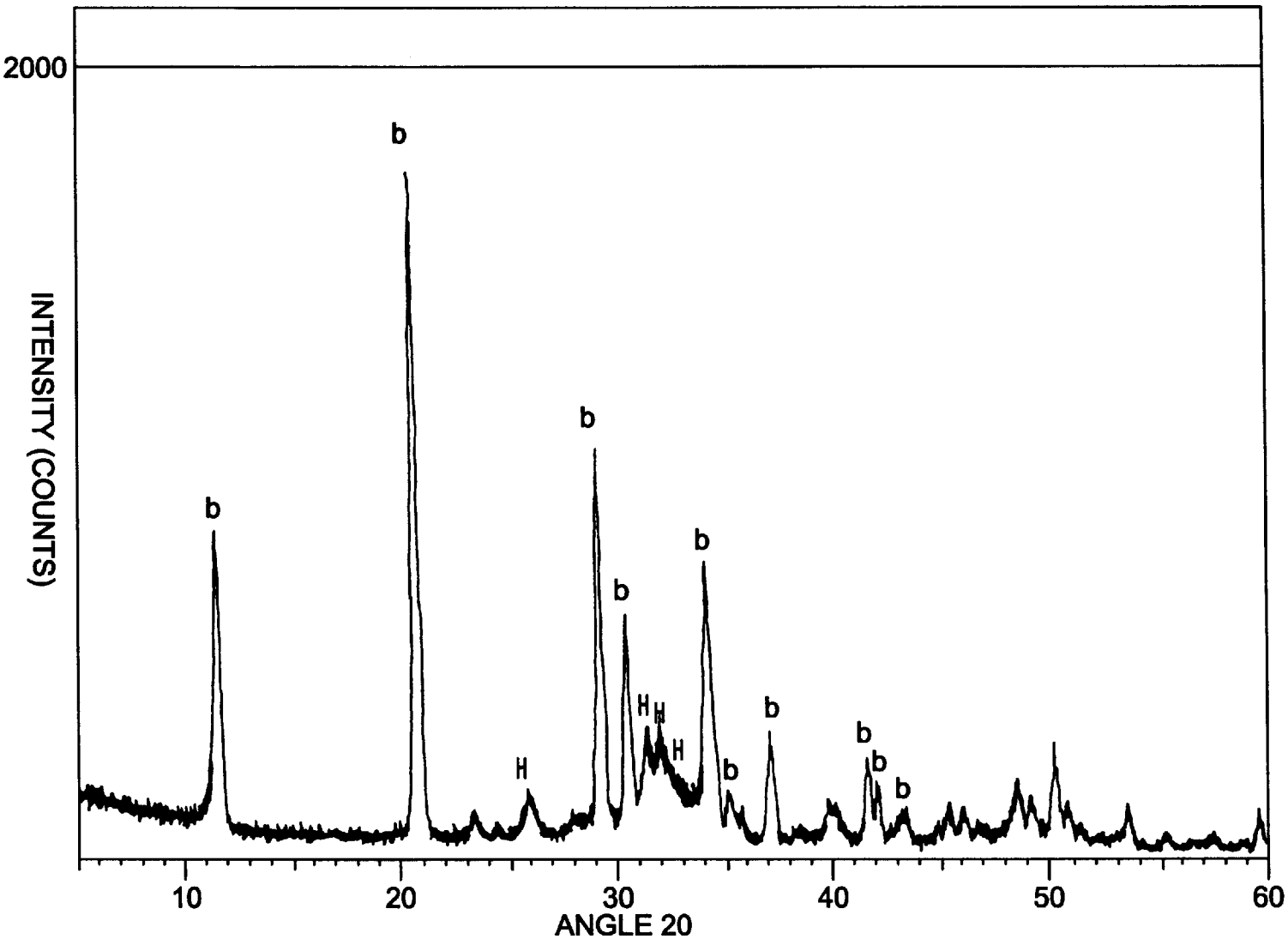
FIG. 6 is an X-ray diffraction spectrum for an unmodified brushite after 18 hours of immersion in a simulated body fluid at room temperature.

The invention provides a fast conversion to hydroxyapatite in a mild fluid and at mild temperatures of from about 20 to 37° C. FIGS. 5 and 6 compare the X-ray diffraction spectra of the modified brushite and unmodified brushite, respectively, after 18 hours of immersion in the simulated body fluid at 25° C. Little change is noted in the unmodified brushite. However, change in the modified brushite is dramatic. Standard hydroxyapatite peak locations according to the Joint Committee for Powder Diffraction Standards are labeled "H" in the figures and show dramatic peak development in FIG. 5, whereas FIG. 6 shows only moderate peak development.

Figure 7:
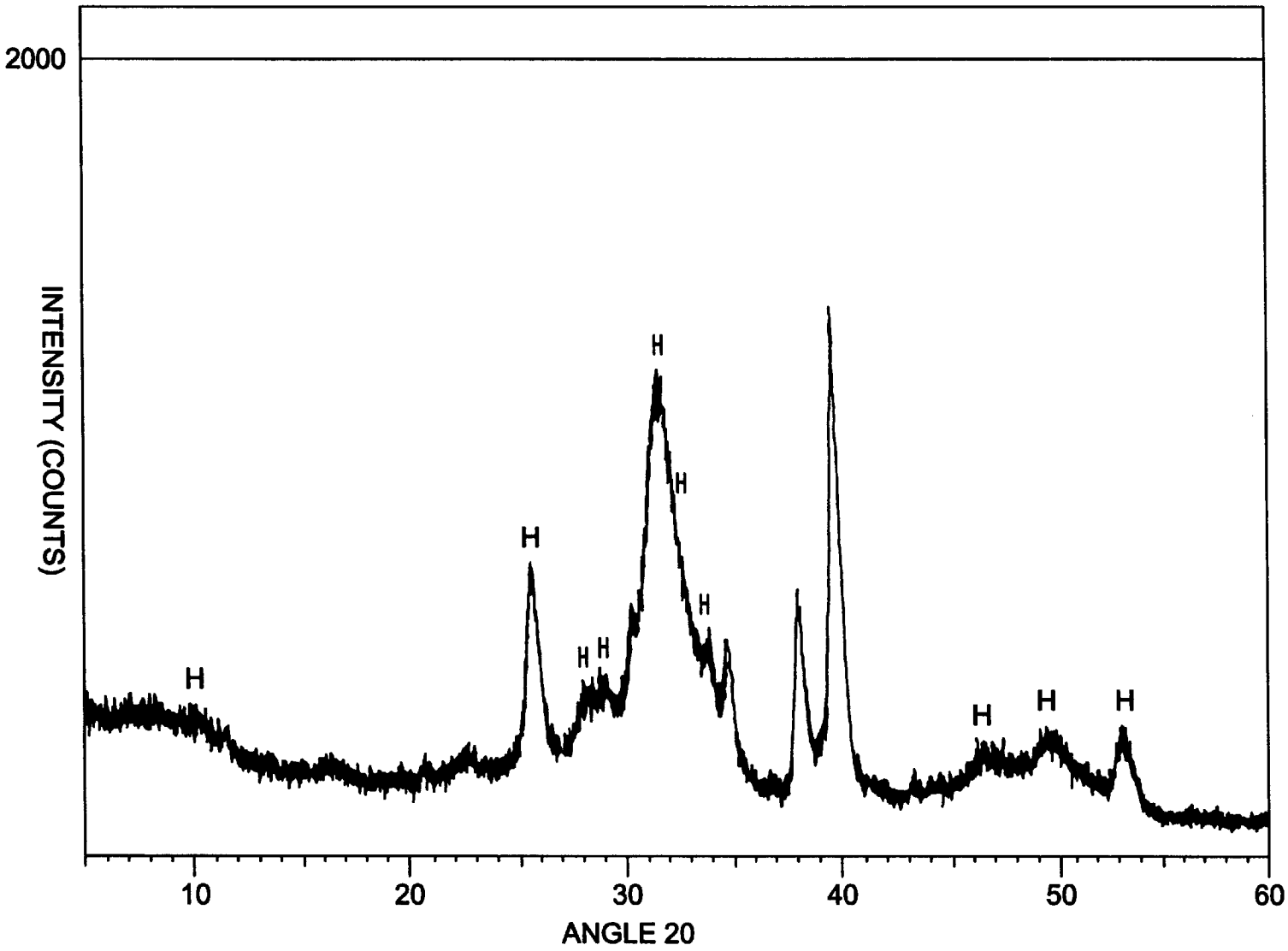
FIG. 7 is an X-ray diffraction spectrum for a modified brushite of the invention after 24 hours of immersion in a simulated body fluid at room temperature.
Figure 8:
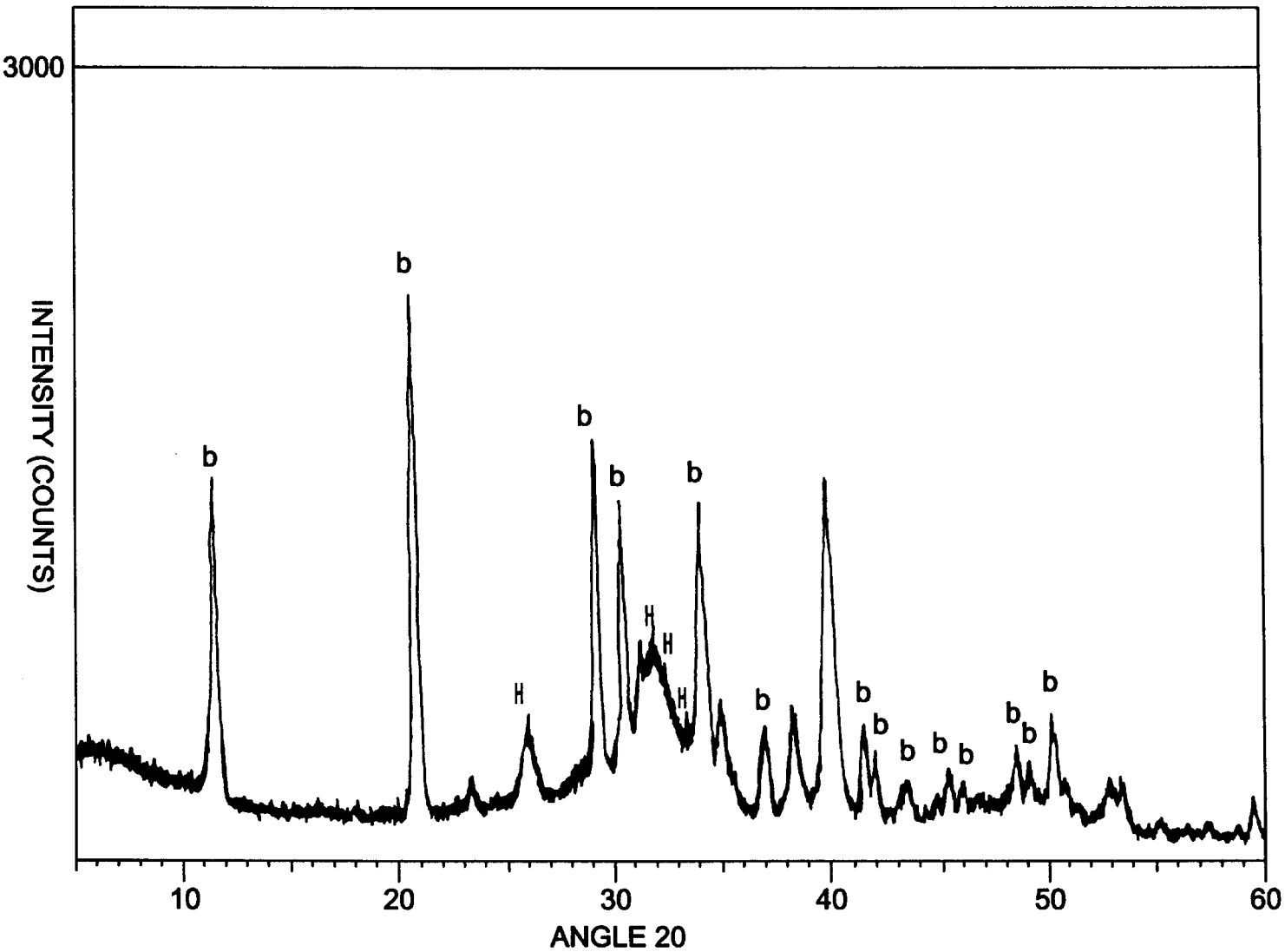
FIG. 8 is an X-ray diffraction spectrum for an unmodified brushite after 24 hours of immersion in a simulated body fluid at room temperature.

FIGS. 7 and 8 compare the modified and unmodified brushites, respectively, after 24 hours of immersion in simulated body fluids. Dramatic development of hydroxyapatite peaks is shown in the modified brushite of FIG. 7.

Figure 9:
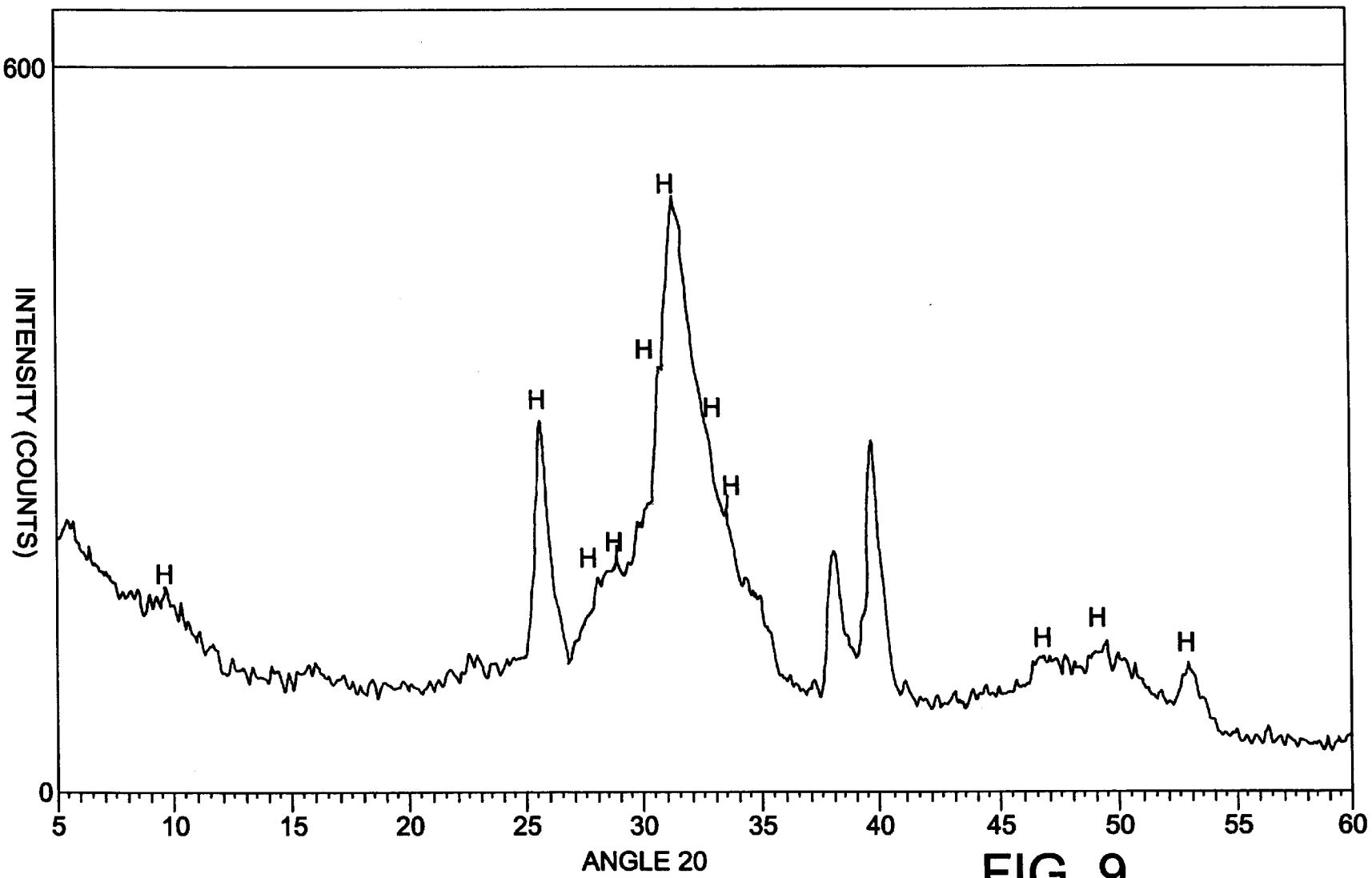
FIG. 9 is an X-ray diffraction spectrum for a modified brushite of the invention after 48 hours of immersion in a simulated body fluid at room temperature.
Figure 10:
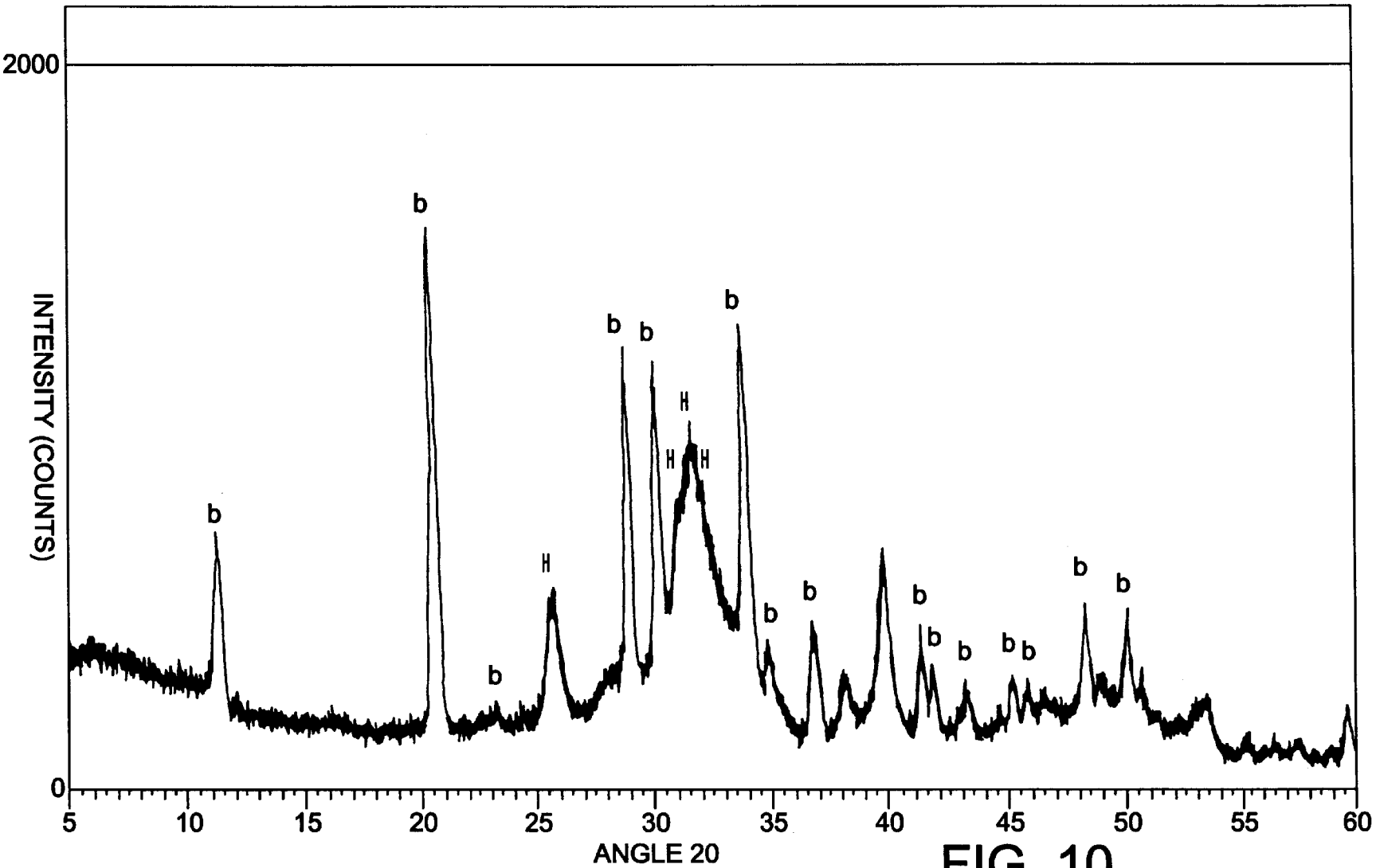
FIG. 10 is an X-ray diffraction spectrum for an unmodified brushite after 48 hours of immersion in a simulated body fluid at room temperature.

FIGS. 9 and 10 compare the modified and unmodified brushites, respectively, after 48 hours of immersion in the simulated body fluid. FIG. 9 shows that transformation of the modified brushite to hydroxyapatite is essentially complete within 48 hours. However, the transformation of the unmodified brushite at 48 hours is equivalent to that of the modified brushite after 18 hours of immersion in the same fluid, as seen in FIG. 5.

The electrolytic cell that is used in the practice of the invention typically will have an anode that comprises a metal such as lead, platinum, or a conducting inert element, including graphite. Other inert conducting elements and other metals can be used as the anode as should be apparent to the skilled artisan. However, lead, graphite, and platinum are probably the most likely to be used.

The cathode typically will be a conductive metal substrate for the brushite coating of the invention and will most typically be a metal that is suitable for implantation in the human body for use, for example, as a knee or hip replacement. These metals typically will be titanium, titanium alloys, including Ti-6AL-4B, stainless steel, including 316 stainless steel, tantalum, alloys of cobalt and chromium, and alloys of cobalt, chromium, and molybdenum, some of which are marketed under the trademarks VITALIUM and ZIMALOY. Cathode and anode separation is typically about 1 centimeter in the electrolytic cell.

The electrolyte is typically an aqueous solution of a conductive chloride salt in a concentration of from about 0.5 to 2 moles per liter, and normally in a concentration of about 1 mole per liter. The chloride salt is selected from ammonium chloride salt and the chloride salts of the Group IA and IIA metals of the Periodic Table. For example, ammonium chloride, sodium chloride, potassium chloride, magnesium chloride, and barium chloride can be used. Other alkali and alkaline earth metal chlorides and the same cations with other anions may also be used.

The electrolyte will also typically comprise a calcium salt, calcium dihydrogen phosphate, which is also known as calcium phosphate, monobasic, calcium biphosphate, acid calcium phosphate, calcium phosphate primary, and monocalcium phosphate. The formula for calcium dihydrogen phosphate is $CaH_4(PO_4)_2.H_2O$. The calcium salt is normally added to the aqueous solution of the conductive salt.

The calcium dihydrogen phosphate is typically saturated in an aqueous solution of the electrolyte. The electrodeposition can be carried out gavanostatically at a voltage sufficient to obtain a current density of from about 10 to 150 milliamperes per square centimeter, depending on the deposition conditions. Voltage should range from about 2.5 to about 4 Volts. The temperature of the electrolytic bath is typically from 20 to 37° C. It has been determined that a 25° C. to 30° C. electrolyte temperature is useful. The duration of the electrolysis operation is typically from about 0.5 to 5 minutes depending upon the thickness of the coating desired. The initial pH is typically about 2.8 given the components of the electrolyte.

It should be recognized that the above ranges for the electrolysis conditions are exemplary and should not be considered in limitation of the invention. For example, the electrolysis can be carried out in a temperature range that requires no heating or cooling of the electrolyte. The invention is operable outside the range of ambient temperatures if desired, although not necessarily with equivalent results. Generally speaking, higher temperatures can be expected to increase the deposition rate and lower temperatures will slow down the deposition rate.

The electroylte is normally sufficiently conductive so that the electrical requirements for the system are comparatively low. The system can be operated outside the ranges given, if desired, although not necessarily with equivalent results.

In a specific example, an electrolyte was prepared from an aqueous solution of potassium chloride at a concentration of 1 mole per liter. The electrolyte solution was saturated with calcium dihydrogen phosphate and had an initial pH of 2.8. The electrolytic cell included a platinum anode and a titanium cathode. The platinum anode measured 4 cm. square. The titanium cathode measured 1 cm. square. Separation between the anode and the cathode was 1 centimeter. A voltage of 3.5 Volts was applied to generate a current of 100 mA for a period of 2 minutes to obtain a suitable coating.

The foregoing description is to be considered illustrative rather than restrictive of the invention. While this invention has been described in relation to its specific embodiments, it is to be understood that various modifications thereof will be apparent to those of ordinary skill in the art upon reading the specification and it is intended to cover all such modifications that come within the meaning and range of equivalence of the appended claims.

That which is claimed:

1. A calcium phosphate ceramic coating applied to a substrate, said coating comprising brushite in which at least a portion of the calcium cations have been replaced with cations selected from the group consisting of ammonium, cations of metals of Group IA of the Periodic Table, cations of metals of Group IIA of the Periodic Table other than calcium, and mixtures thereof.

2. A brushite coating according to claim 1 wherein the replacement cations are selected from the group consisting of ammonium, sodium, potassium, magnesium, and barium.

3. A brushite coating according to claim 1 wherein from about 1 to 50%, by atomic percent, of the calcium ions in the brushite have been replaced with cations selected from the group consisting of ammonium, cations of metals of Group IA of the Periodic Table, cations of metals of Group IIA of the Periodic Table, and mixtures thereof.

4. A brushite coating according to claim 1 wherein the brushite is crystalline and has the formula $X_a$—$HPO_4.2H_2O$, wherein X is a cation selected from the group consisting of calcium, ammonium, cations of metals of Group IA of the Periodic Table, cations of metals of Group IIA of the Periodic Table, and mixtures thereof, and wherein "a" is 1 for Group IIA metals and 2 for ammonium and Group IA metals.

5. A brushite coating according to claim 1 wherein the x-ray diffraction pattern of the brushite shows highest intensity peaks at angle planes higher than for brushite in which calcium cations are not replaced.

6. A brushite coating according to claim 5 wherein highest intensity peaks are at about 30.5 and 34.3 degrees.

7. A brushite coating according to claim 1 wherein said substrate is a metal suitable for medical implants.

8. A calcium phosphate ceramic coating applied to a metal substrate, said coating comprising crystalline brushite of the formula $X_a$—$HPO_4.2H_2O$, wherein from about 95 to 99 atomic % of said cations X are calcium cations and wherein the remainder of said cations X are selected from the group consisting of ammonium, cations of metals of Group IA of the Periodic Table other than calcium, cations of metals of Group IIA of the Periodic Table, and mixtures thereof, and wherein "a" is 1 for Group IIA metals and 2 for ammonium and Group IA metals.

9. A brushite coating according to claim 8 wherein the x-ray diffraction pattern of the brushite shows highest intensity peaks at angle planes of about 30.5 and 34.3 degrees.

10. A crystalline composition of the formula $X_a$—$HPO_4.2H_2O$, wherein X is a cation selected from the group consisting of calcium, ammonium, cations of metals of Group IA of the Periodic Table, cations of metals of Group IIA of the Periodic Table, and mixtures thereof, and wherein "a" is 1 for Group IIA metals and 2 for ammonium and Group IA metals, and wherein at least some of the cations X are not calcium.

11. The crystalline composition of claim 10 wherein from about 95 to 99% of said cations X are calcium cations.

12. A method of applying a coating to a metal substrate comprising the step of electrodepositing a coating on a metal substrate from an aqueous solution of calcium phosphate, monobasic and salts having cations selected from the group consisting of ammonium; cations of metals of Group IA of the Periodic Table; cations of metals of Group IIA of the Periodic Table and mixtures thereof wherein at least some of the cation are not calcium.

13. A method according to claim 12 further comprising the step of converting the electrodeposited coating to calcium hydroxyapatite.

14. A method according to claim 13 wherein the step of converting the electrodeposited coating to calcium hydroxyapatite is substantially completed within 48 hours.

15. A method according to claim 13 wherein the electrodeposited coating is converted to calcium hydroxyapatite by contacting the coating with an animal or human body fluid or a substance simulating the composition of a body fluid.

16. A method according to claim 15 wherein calcium hydroxyapatite has the formula $Ca_{(10-x)}(HPO_4)_x(PO_4)_{(2-x)}$, where $0 \leqq x \leqq 1$.

17. A method according to claim 15 wherein the electrodeposited coating is converted to calcium hydroxyapatite by contacting the coating with an animal or human body fluid in vivo.

18. A method according to claim 15 wherein the simulated body fluid comprises sodium chloride, potassium chloride, potassium diphosphate, sodium bicarbonate, and disodium phosphate heptahydrate and the electrodeposited coating is converted to calcium hydroxyapatite by contacting the coating with a simulated body fluid at a temperature of from about 20 to 37° C.

19. A method according to claim 18 wherein sodium chloride is present in an amount of about 8 g/l, potassium chloride is present in an amount of about 0.4 g/l, potassium diphosphate is present in an amount of about 0.06 g/l, sodium bicarbonate is present in an amount of about 0.35 g/l, and disodium phosphate heptahydrate is present in an amount of about 0.09 g/l.

20. An electrolytic method for coating a metal cathode with a coating comprising the steps of:

a) preparing an electrolytic cell comprising a metal cathode and an aqueous solution of calcium phosphate monobasic and one or more salts having cations selected from the group consisting of ammonium; cations of metals of Group IA of the Periodic Table; cations of metals of Group IIA of the Periodic Table and mixtures thereof wherein at least some of the cations are not calcium; and b) passing an electric current through the electrolyte sufficient to electrodeposit a coating on a metal cathode comprising a crystalline composition of the formula $X_a$—$HPO_4.2H_2O$, wherein X is a cation selected from the group consisting of calcium, ammonium, cations of metals of Group IA of the Periodic Table, cations of metals of Group IIA of the Periodic Table, and mixtures thereof, wherein "a" is 1 for Group IIA metals and 2 for ammonium and Group IA metals, and wherein at least some of the cations X are not calcium.

21. A method according to claim 20 wherein in the composition of the formula $X_a$—$HPO_4.2H_2O$, X is from about 95 to 99% calcium cations.

22. A method according to claim 20 further comprising the step of controlling the thickness of the coating.

23. A method according to claim 22 wherein the step of controlling the thickness of the coating comprises galvanostatically controlling the deposition rate and the deposition time.

24. A method according to claim 20 wherein the step of passing an electric current through the electrolyte sufficient to electrodeposit a coating on a metal cathode comprises applying a voltage of from about 2.5 to 4 Volts to obtain a current density of from about 10 to 150 milliamps per square centimeter for a time of from about 0.5 to 5 minutes in an electrolyte at an initial pH of about 2.8 and a temperature of from about 20 to 37° C.

25. A method according to claim 24 wherein the temperature of the electrolyte is about 25° C.

26. An electrolytic method for coating a metal cathode with a calcium hydroxyapatite coating comprising the steps of:

a) preparing an electrolytic cell comprising a metal cathode and an aqueous electrolyte solution of calcium phosphate monobasic and one or more salts having cations selected from the group consisting of ammonium, cations of metals of Group IA of the Periodic Table; cations of metals of Group HA of the Periodic Table and mixtures thereof wherein at least some of the cations are not calcium;

b) applying a voltage of from about 2.5 to 4 Volts to obtain a current density of from about 10 to 150 milliamps per square centimeter for a time of from about 0.5 to 5 minutes in an electrolyte at an initial pH of about 2.8 and a temperature of from about 20 to 37° C. sufficient to electrodeposit a coating on a metal cathode comprising a crystalline composition of the formula $X_a$—$HPO_4.2H_2O$, wherein X is a cation selected from the group consisting of calcium, ammonium, cations of metals of Group IA of the Periodic Table, cations of metals of Group IIA of the Periodic Table, and mixtures thereof, wherein "a" is 1 for Group IIA metals and 2 for ammonium and Group IA metals, and wherein X is from about 95 to 99% calcium cations;

c) galvanostatically controlling the deposition rate and the deposition time; and d) converting the electrodeposited coating to calcium hydroxyapatite within 48 hours by contacting the coating with an animal or human body fluid or a substance simulating the composition of a body fluid.

27. A method according to claim 26 wherein calcium hydroxyapatite has the formula $Ca_{(10-x)}(HPO_4)_x(PO_4)_{(6-x)}(OH)_{(2-x)}$, where $0 \leqq x \leqq 1$.

28. A process for converting a brushite coating to a calcium hydroxyapatite coating comprising contacting the brushite coating with an animal or human body fluid or a substance simulating the composition of a body fluid at a temperature of from about 20 to 37° C.

29. A process according to claim 28 wherein calcium hydroxyapatite has the formula $Ca_{(10-x)}(HPO_4)_x(PO_4)_{(6-x)}(OH)_{(2-x)}$, where $0 \leqq x \leqq 1$.

30. A process for converting a brushite coating to a calcium hydroxyapatite coating comprising contacting the brushite coating with an animal or human body fluid in vivo.

31. A process for converting a brushite coating to a calcium hydroxyapatite coating comprising contacting the brushite coating with an animal or human body fluid or a substance simulating the composition of a body fluid, wherein said brushite coating comprises brushite in which at least a portion of the calcium cations have been replaced with cations selected from the group consisting of ammonium, cations of metals of Group IA of the Periodic Table, cations of metals of Group IIA of the Periodic Table other than calcium, and mixtures thereof.

32. A process according to claim 31 wherein the simulated body fluid comprises sodium chloride, potassium chloride, potassium diphosphate, sodium bicarbonate, and disodium phosphate heptahydrate and the brushite coating is converted to calcium hydroxyapatite by contacting the coating with a simulated body fluid at a temperature of from about 20 to 37° C.

33. A process according to claim 31 wherein the step of converting the electrodeposited coating to calcium hydroxyapatite is substantially completed within 48 hours.

34. A process according to claim 31 wherein the brushite coating is converted to calcium hydroxyapatite by contacting the coating with an animal or human body fluid in vivo.

* * * * *

UNITED STATES PATENT AND TRADEMARK OFFICE
CERTIFICATE OF CORRECTION

PATENT NO. : 6,045,683

DATED : April 4, 2000

INVENTOR(S) : Riley et al.

It is certified that error appears in the above-identified patent and that said Letters Patent is hereby corrected as shown below:

Title page, [56] References Cited, U.S. PATENT DOCUMENTS, lines 3 and 6, "Redpenning" should read --Redepenning--.

Column 6, line 63, "1 to 50%" should read --1 to 5%--.

Column 7, lines 19 and 31, "$X_a$-$HPO_4$.$2H_2O$", each occurrence, should read --$X_a$-$HPO_4 \cdot 2H_2O$--;

Column 7, line 60 "$Ca_{(10-x)}(HPO_4)_x(PO_4)_{(2-x)}$, where $0 \leqq x \leqq 1$" should read --$Ca_{(10-x)}(HPO_4)_x(PO_4)_{(6-x)}(OH)_{(2-x)}$, where $0 \leq x \leq 1$--.

Column 8, line 22, after "calcium" insert ; and mixtures thereof--; lines 26 and 34; "$X_a$-$HPO_4$.$2H_2O$", each occurrence, should read --$X_a$-$HPO_4 \cdot 2H_2O$--; line 60, "Group HA" should read --Group IIA--; line 61, cancel "and mixtures thereof";

Column 9, line 3, "$X_a$-$HPO_4$.$2H_2O$" should read --$X_a$-$HPO_4 \cdot 2H_2O$--; lines 18 and 26, "$0 \leqq x \leqq 1$", each occurrence, should read --$0 \leq x \leq 1$--.

Signed and Sealed this

Sixth Day of March, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,045,683
DATED : April 4, 2000
INVENTOR(S) : Riley et al.

It is certified that error appears in the above-identified patent and that said Letters Patent is hereby corrected as shown below:

Title page,
Item [56], References Cited, OTHER PUBLICATIONS,
Line 3, "Apr. 1992" should read -- Jan. 1992 --.

Column 1,
After the title, insert the following paragraph:

-- Government License Rights

The United States Government has rights in this invention as provided for by the terms of Contract Numbers NAGW-812 and NCC8-132 awarded by the National Aeronautics and Space Administration, and Contract Number EPS-9550480 awarded by the National Science Foundation. --.

Column 7,
Line 46, after "Table" cancel "and mixtures thereof";
Line 47, after "calcium" insert --; and mixtures thereof --;
Line 47, "cation" should read -- cations --.

Column 8,
Line 21, cancel "and mixtures thereof";
Line 62, after "calcium" insert --; and mixtures thereof --.

Signed and Sealed this

Fifth Day of March, 2002

*Attest:*

*Attesting Officer*

JAMES E. ROGAN
*Director of the United States Patent and Trademark Office*